US010903539B2

(12) United States Patent
Yuan et al.

(10) Patent No.: US 10,903,539 B2
(45) **Date of Patent: *Jan. 26, 2021**

(54) DIELECTRIC RESONATOR HAVING A SEALED DEMETALLIZED NOTCH FORMED THEREIN, FOR FORMING A DIELECTRIC FILTER AND A BASE STATION THEREFROM

(71) Applicant: Huawei Technologies Co., Ltd., Shenzhen (CN)

(72) Inventors: Bengui Yuan, Shanghai (CN); Qiang Wang, Shanghai (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 0 days.

This patent is subject to a terminal disclaimer.

(21) Appl. No.: 16/405,705

(22) Filed: May 7, 2019

(65) Prior Publication Data

US 2019/0267689 A1 Aug. 29, 2019

Related U.S. Application Data

(63) Continuation of application No. 15/691,246, filed on Aug. 30, 2017, now Pat. No. 10,320,044, which is a (Continued)

(51) Int. Cl.
*H01P 1/205* (2006.01)
*H01P 7/04* (2006.01)
(Continued)

(52) U.S. Cl.
CPC ..... *H01P 1/2056* (2013.01); *H01P 1/2002* (2013.01); *H01P 1/2084* (2013.01); *H01P 7/04* (2013.01); *H01P 7/10* (2013.01)

(58) Field of Classification Search
CPC ..... H01P 1/2053; H01P 1/2056; H01P 7/04; H01P 1/2002
(Continued)

(56) References Cited

U.S. PATENT DOCUMENTS 2,704,830 A 3/1955 Rosencrans
4,691,179 A 9/1987 Blum et al.
(Continued)

FOREIGN PATENT DOCUMENTS

CN 1301055 A 6/2001
CN 1617384 A 5/2005
(Continued)

*Primary Examiner* — Benny T Lee
(74) *Attorney, Agent, or Firm* — Leydig, Voit & Mayer, Ltd.

(57) ABSTRACT

A dielectric resonator, a dielectric filter, a base station and a method for fabricating the dielectric resonator or the dielectric filter are provided. The dielectric resonator includes: a solid dielectric resonator body, a blind hole located on one side of the solid dielectric resonator body, a metalized layer covering both a surface of the solid dielectric resonator body and a surface of the blind hole, and a demetallized notch located at the metalized layer on the surface of the blind hole. The dielectric resonator provided in the present application can implement tuning of the dielectric resonator, and reduce impact on the resonance frequency of the dielectric resonator after the dielectric resonator is tuned, where the impact caused by that the demetallized notch is covered by a metal material in an assembly process of the dielectric resonator, and signal energy that is leaked from the notch is reduced.

17 Claims, 4 Drawing Sheets

Related U.S. Application Data continuation of application No. 14/884,532, filed on Oct. 15, 2015, now Pat. No. 9,780,428, which is a continuation of application No. PCT/CN2013/074257, filed on Apr. 16, 2013.

(51) Int. Cl.
*H01P 1/208* (2006.01)
*H01P 1/20* (2006.01)
*H01P 7/10* (2006.01)

(58) Field of Classification Search
USPC ..... 333/202, 223, 203
See application file for complete search history.

(56) References Cited

U.S. PATENT DOCUMENTS

| | | | |
|---|---|---|---|
| 4,837,534 A | 6/1989 | Van Horn | |
| 5,614,875 A | 3/1997 | Jang et al. | |
| 5,815,056 A | 9/1998 | Tada et al. | |
| 5,828,275 A | 10/1998 | Kita et al. | |
| 6,002,306 A | 12/1999 | Arakawa | |
| 6,060,965 A | 5/2000 | Sung et al. | |
| 6,556,101 B1 | 4/2003 | Tada et al. | |
| 6,737,943 B2 | 5/2004 | Takubo et al. | |
| 9,780,428 B2 * | 10/2017 | Yuan et al. | H01P 1/2056 |
| 10,320,044 B2 * | 6/2019 | Yuan et al. | H01P 7/04 |
| 2001/0000429 A1 | 4/2001 | Arakawa et al. | |
| 2001/0024147 A1 | 9/2001 | Arakawa et al. | |
| 2005/0122192 A1 | 6/2005 | Yoshikawa et al. | |
| 2013/0176088 A1 | 7/2013 | Mao et al. | |

FOREIGN PATENT DOCUMENTS

| | | |
|---|---|---|
| CN | 102136620 A | 7/2011 |
| CN | 103000983 A | 3/2013 |
| DE | 1052484 B | 3/1959 |
| GB | 2284942 B | 6/1997 |
| JP | H07170103 A | 7/1995 |
| JP | 2003304101 A | 10/2003 |
| JP | 2004312288 A | 11/2004 |
| KR | 100932705 B1 | 12/2009 |
| WO | 2013050636 A1 | 4/2013 |

* cited by examiner

DIELECTRIC RESONATOR HAVING A SEALED DEMETALLIZED NOTCH FORMED THEREIN, FOR FORMING A DIELECTRIC FILTER AND A BASE STATION THEREFROM

CROSS-REFERENCE TO RELATED APPLICATIONS

This application is a continuation of U.S. patent application Ser. No. 15/691,246, filed on Aug. 30, 2017, now U.S. Pat. No. 10,320,044, which is a continuation of U.S. patent application Ser. No. 14/884,532, filed on Oct. 15, 2015, now U.S. Pat. No. 9,780,428, which is a continuation of International Patent Application No. PCT/CN2013/074257, filed on Apr. 16, 2013. All of the afore-mentioned patent applications are hereby incorporated by reference in their entireties.

TECHNICAL FIELD

Embodiments of the present invention relate to the field of communications technologies, and in particular, to a dielectric resonator, a dielectric filter, and a fabrication method.

BACKGROUND

As wireless communications technologies increasingly develop, wireless communications base stations are distributed more densely, requiring base stations with a smaller volume. A volume of a radio frequency front-end filter module in an RFU (radio frequency unit) or an RRU (remote radio unit) of a base station is relatively large, thereby requiring a filter with a smaller volume. Considering communication quality, performance (such as insertion loss, suppression, and a power capacity) of the filter needs to remain unchanged after the volume is reduced.

Radio frequency filters have developed for decades, and a variety of filters emerge in various forms; relatively common implementation forms are a metal coaxial cavity, a transverse electric (TE) mode dielectric cavity, a transverse magnetic (TM) mode dielectric cavity, a transverse electromagnetic (TEM) mode dielectric cavity, a waveguide, a microstrip, a thin-film bulk acoustic resonator (FBAR), a bulk acoustic wave (BAW), a surface acoustic wave (SAW), and the like. Radio frequency represents an electromagnetic frequency that may be radiated to space and ranges from 300 KHz to 30 GHz.

Among the filters in various forms are filters with a relatively large volume (such as the TE mode dielectric cavity and the waveguide), filters with a relatively moderate volume (such as the metal coaxial cavity and the TM mode dielectric cavity), filters with a relatively small volume (the TEM mode dielectric cavity and the microstrip), and filters with a very small volume (FBAR, BAW, SAW, and the like). However, as analyzed from the perspective of a basic electromagnetic theory, a filter with a smaller volume causes a larger surface current, a larger loss, and a lower power bearing capability, namely, a smaller power capacity. In conclusion, a filter with a smaller volume has worse performance (loss, suppression, a power capacity, and the like).

According to a requirement of a wireless base station on performance (including insertion loss, suppression, and power) of the filter, the metal coaxial cavity, the TE mode dielectric cavity, and the TM mode dielectric cavity are commonly used currently, and the metal coaxial cavity is most commonly used. Other miniaturized filters such as a TEM mode dielectric filter and the FBAR cannot be applied to the radio frequency front-end of a large-power base station because a performance indicator of the miniaturized filters cannot meet a requirement.

At present, there is a miniaturized filter, which uses a resonator formed by a metalized (for example, silver plated) solid dielectric waveguide surface (dielectric resonator for short). Generally, the radio frequency filter (including a microwave filter) has a relatively strict indicator specification requirement (such as echo, insertion loss, and suppression). A resonance frequency of each resonator of a filter and coupling between resonators need to be accurate. However, due to causes such as a manufacturing size error in product design, a design error, and an error of a dielectric constant of a dielectric, the resonance frequency of the dielectric resonator is inaccurate and needs to be tuned.

A current tuning solution is generally to demetallize at least one of an upper surface or a bottom surface of the dielectric resonator by means of polishing. FIG. 1*a* and FIG. 1*b* are schematic diagrams of demetallizing the bottom surface of the dielectric resonator by means of polishing. FIG. 1*a* is a longitudinal section view and FIG. 1*b* is a bottom view, where 10 (FIG. 1*a*) represents a solid dielectric resonator body, 101 represents a metalized layer of a surface of the solid dielectric resonator body, and 102 represents a demetallized notch after the surface of the solid dielectric resonator body is polished. In this tuning solution, the inventor finds in the process of invention that in an assembly process of the resonator, the demetallized notch may be covered by a metalized surface of some components, and consequently the resonance frequency of the resonator changes and deviates from a tuned resonance frequency, thereby affecting working performance of the resonator.

SUMMARY OF THE INVENTION

In view of this problem, embodiments of the present invention provide a dielectric resonator, a method for fabricating the dielectric resonator, a dielectric filter, and a method for fabricating the dielectric filter, so as to facilitate performance tuning of a resonator and improve performance retentivity after tuning.

According to a first aspect, an embodiment of the present invention provides a dielectric resonator, including: a solid dielectric resonator body, a blind hole located on one side of the solid dielectric resonator body, a metalized layer covering both a surface of the solid dielectric resonator body and a surface of the blind hole, and a demetallized notch located at the metalized layer on the surface of the blind hole.

According to the first aspect, in a first possible implementation manner, the dielectric resonator further includes: a metalized sealing part that is configured to seal the demetallized notch and that is located at a specific spacing away from the demetallized notch.

According to the first possible implementation manner of the first aspect, in a second possible implementation manner, the metalized sealing part is located inside the blind hole and connected to the surface of the blind hole, and a surface, in a same direction as an opening of the blind hole, of the metalized sealing part is a metalized surface; or the metalized sealing part is located outside the blind hole and connected to a metalized layer surrounding an opening side of the blind hole, and a surface, connecting to the metalized layer surrounding the opening side of the blind hole, of the metalized sealing part is a metalized surface.

According to the first possible implementation manner or the second possible implementation manner of the first aspect, in a third possible implementation manner, the spacing is used to reduce impact of the metalized sealing part on a frequency of the dielectric resonator.

According to the third possible implementation manner of the first aspect, in a fourth possible implementation manner, a width of the spacing is related to a dielectric constant of a dielectric of the dielectric resonator and a resonance frequency of the dielectric resonator.

According to the first aspect, or any one of the first to the fourth possible implementation manners of the first aspect, in a fifth possible implementation manner, the demetallized notch is related to the resonance frequency of the dielectric resonator.

According to the fifth possible implementation manner of the first aspect, in a sixth possible implementation manner, that the demetallized notch is related to the resonance frequency of the dielectric resonator is specifically that an area of the demetallized notch is related to the resonance frequency of the dielectric resonator.

According to the first aspect, or any one of the first to the sixth possible implementation manners of the first aspect, in a seventh possible implementation manner, the demetallized notch is located at the inner bottom of the blind hole.

According to the first aspect, or any one of the first to the seventh possible implementation manners of the first aspect, in an eighth possible implementation manner, a quantity of demetallized notches is one or more.

According to the first aspect, or any one of the first to the eighth possible implementation manners of the first aspect, in a ninth possible implementation manner, a depth of the blind hole is determined according to the dielectric constant of the dielectric of the dielectric resonator and the resonance frequency of the dielectric resonator.

According to a second aspect, an embodiment of the present invention provides a dielectric filter, where the dielectric filter includes the dielectric resonator according to the first aspect or any one of the first to the ninth possible implementation manners of the first aspect.

According to a third aspect, an embodiment of the present invention provides a method for fabricating a dielectric resonator, including:

forming a blind hole in a solid dielectric that forms the dielectric resonator;

performing overall metallization on the solid dielectric that provides the blind hole, to form a metalized layer of the dielectric resonator; and removing a part of the metalized layer from the metalized layer on a surface of the blind hole, to form a demetallized notch.

According to the third aspect, in a first possible implementation manner, the method for fabricating a dielectric resonator further includes: disposing, inside the blind hole, a metalized sealing part that is configured to seal the demetallized notch and that is located at a specific spacing away from the demetallized notch, where a surface, in a same direction as an opening of the blind hole, of the metalized sealing part is a metalized surface.

According to the first possible implementation manner of the third aspect, in a second possible implementation manner, the spacing is used to reduce impact of the metalized sealing part on a frequency of the dielectric resonator.

According to the first possible implementation manner or the second possible implementation manner of the third aspect, in a third possible implementation manner, a width of the spacing is related to a dielectric constant of a dielectric of the dielectric resonator and a resonance frequency of the dielectric resonator.

According to the third aspect, in a fourth possible implementation manner, the method for fabricating a dielectric resonator further includes: disposing, at a metalized layer surrounding an opening side of the blind hole, a metalized sealing part that is configured to seal the demetallized notch, where a surface, connecting to the metalized layer surrounding the opening side of the blind hole, of the metalized sealing part is a metalized surface.

According to the third aspect, or any one of the first to the fourth possible implementation manners of the third aspect, in a fifth possible implementation manner, the removing a part of the metalized layer from the metalized layer on a surface of the blind hole is specifically tuning the resonance frequency of the dielectric resonator by controlling an area of the removed metalized layer.

According to the third aspect, or any one of the first to the fifth possible implementation manners of the third aspect, in a sixth possible implementation manner, the removing a part of the metalized layer from the metalized layer on a surface of the blind hole, to form a demetallized notch is specifically removing a part of the metalized layer from the metalized layer on a surface at the inner bottom of the blind hole, to form the demetallized notch.

According to the third aspect, or any one of the first to the sixth possible implementation manners of the third aspect, in a seventh possible implementation manner, the removing a part of the metalized layer from the metalized layer on a surface of the blind hole, to form a demetallized notch is specifically removing at least one place of a metalized layer from the metalized layer on the surface of the blind hole, to form at least one metalized notch.

According to the third aspect, or any one of the first to the seventh possible implementation manners of the third aspect, in an eighth possible implementation manner, a depth of the blind hole is determined according to the dielectric constant of the dielectric of the dielectric resonator and the resonance frequency of the dielectric resonator.

According to a fourth aspect, an embodiment of the present invention provides a method for fabricating a dielectric filter, including: the method for fabricating a dielectric resonator according to the third aspect and any one of the first to the eighth possible implementation manners of the third aspect, and using the dielectric resonator that is fabricated in the method for fabricating a dielectric resonator to fabricate the dielectric filter.

According to the dielectric resonator, the method for fabricating the dielectric resonator, the dielectric filter, and the method for fabricating the dielectric filter that are provided in the embodiments of the present invention, a demetallized notch that is configured to tune a resonance frequency of the dielectric resonator is disposed inside a blind hole, which therefore can not only implement tuning of the dielectric resonator, but also reduce impact on the resonance frequency of the dielectric resonator after the dielectric resonator is tuned, where the impact is caused by that the demetallized notch is covered by a metal material in an assembly process of the dielectric resonator, thereby improving performance retentivity.

DETAIL DESCRIPTION OF THE PREFERRED EMBODIMENTS

Embodiments of the present invention provide a dielectric resonator, a dielectric filter, and a method for fabricating the dielectric resonator or the dielectric filter, so as to facilitate performance tuning of a resonator and improve performance retentivity after tuning.

Figure 1A:
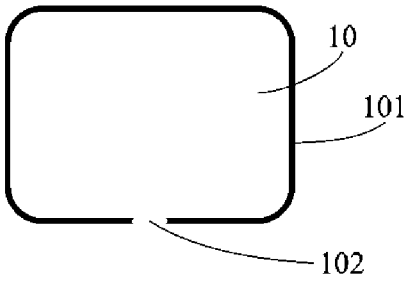
FIG. 1a PRIOR ART
FIG. 1*a* and FIG. 1*b* are schematic diagrams of demetallizing, by means of polishing, a bottom surface of a dielectric resonator in the prior art.
Figure 1B:
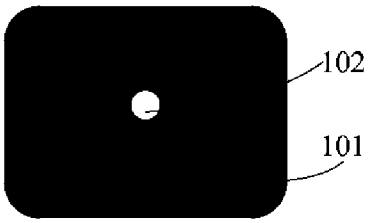
FIG. 1b PRIOR ART
Figure 2:
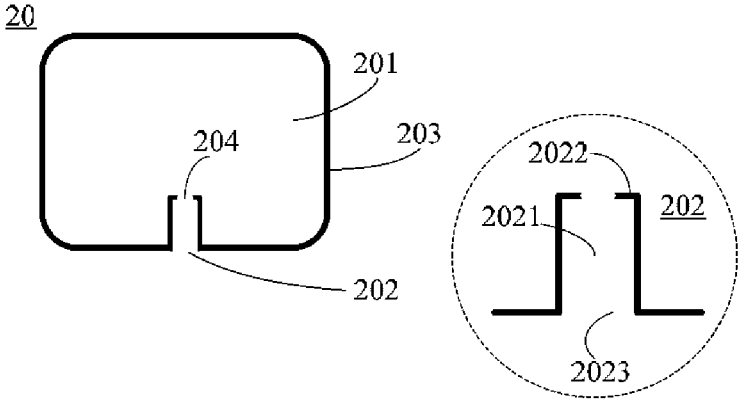
FIG. 2 is a schematic diagram of a longitudinal section of a dielectric resonator according to an embodiment of the present invention.

An embodiment of the present invention provides a dielectric resonator 20, as shown in a schematic diagram of a longitudinal section in FIG. 2. The dielectric resonator 20 includes a solid dielectric resonator body 201, a blind hole 202 located on one side of the solid dielectric resonator body 201, a metalized layer 203 covering both a surface of the solid dielectric resonator body 201 and a surface of the blind hole 202, and a demetallized notch 204 located at the metalized layer 203 of the surface of the blind hole 202.

The demetallized notch 204 located at the metalized layer 203 on the surface of the blind hole 202 is configured to tune a resonance frequency of the dielectric resonator, that is, the demetallized notch 204 is related to the resonance frequency of the dielectric resonator. Specifically, the resonance frequency of the dielectric resonator may be tuned by controlling an area of the demetallized notch 204. A specific relationship between the area of the demetallized notch 204 and the resonance frequency of the resonator may be specifically determined by simulation or test, and details are not described in this embodiment. The demetallized notch 204 may be a notch formed by performing demetallization processing on the metalized layer 203 of the surface of the blind hole 202. In a notch part, the solid dielectric resonator body is visible, that is, a metalized layer of the notch part is demetallized, so that a solid part of a solid dielectric resonator is not covered by a metal layer. For example, if a thickness of the metalized layer is 0.1 mm, a depth of the notch is not less than 0.1 mm. More preferably, the demetallized notch 204 may be located at the inner bottom of the blind hole, and a quantity of demetallized notches is one or more. A shape of the demetallized notch 204 may be a circle, may be a square, or may be another shape, for example, an irregular shape, which may not be specifically limited in this embodiment.

The blind hole 202 is located on one side of the solid dielectric resonator body 201, and specifically, the blind hole 202 may be located on an upper surface or a bottom surface or a lateral side of the solid dielectric resonator body 201, which may not be limited in all the embodiments of the present invention. The blind hole 202 may be a concave blind hole structure, and provides an opening 2021 and an inner bottom 2022, where a side with the opening being level with the solid dielectric resonator body is an opening side 2023.

A specific value of a depth of the blind hole may be determined according to a dielectric constant of a dielectric of the resonator and the resonance frequency of the resonator. Generally, the value is greater than 1 mm. A cross-section of the blind hole may be a circle, may be a square, or may be another shape, for example, an irregular shape, which may not be specifically limited in this embodiment.

The dielectric of the solid dielectric resonator 201 may function as a waveguide.

The metalized layer may be a surface layer formed by any metal, and a forming manner may be plating or laser, or may be another manner that meets an actual requirement, which may not be limited in this embodiment. The metal may be silver or copper, or may be another metal that meets an actual requirement, which may not be limited in this embodiment.

According to the dielectric resonator provided in this embodiment of the present invention, a demetallized notch that is configured to tune a resonance frequency of the dielectric resonator is disposed inside a blind hole, which therefore can-not only implement tuning of the dielectric resonator, but also reduce impact on the resonance frequency of the dielectric resonator after the dielectric resonator is tuned, where the impact is caused by that the demetallized notch is covered by a metal material in an assembly process of the dielectric resonator, thereby improving performance retentivity. In addition, because the demetallized notch is located inside the blind hole, signal energy that is leaked from the notch may be reduced.

Figure 3A:
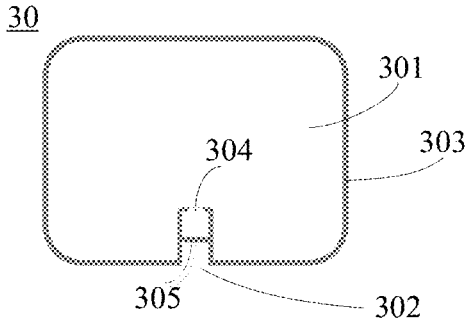
FIG. 3*a* is a schematic diagram of a longitudinal section of a dielectric resonator according to an embodiment of the present invention.
Figure 3B:
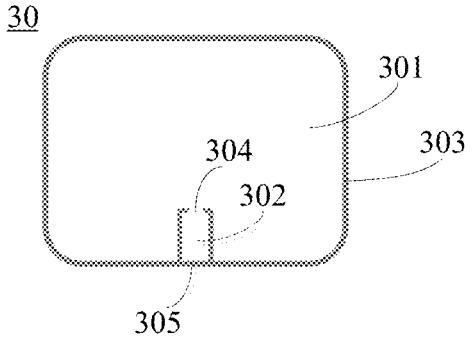
FIG. 3*b* is a schematic diagram of a longitudinal section of a dielectric resonator according to an embodiment of the present invention.
Figure 3C:
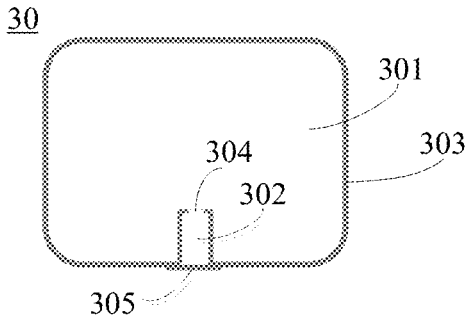
FIG. 3*c* is a schematic diagram of a longitudinal section of a dielectric resonator according to an embodiment of the present invention.

Another embodiment of the present invention provides a dielectric resonator 30, as shown in schematic diagrams of longitudinal sections in FIG. 3*a*, FIG. 3*b*, and FIG. 3*c*. The dielectric resonator 30 includes a solid dielectric resonator body 301, a blind hole 302 located on one side of the solid dielectric resonator body 301, a metalized layer 303 covering both a surface of the solid dielectric resonator body 301 and a surface of the blind hole 302, a demetallized notch 304 located at the metalized layer 303 on the surface of the blind hole 302, and a part 305 that is configured to seal the demetallized notch 304 and that is located a specific spacing away from the demetallized notch 304. It can be seen that a difference between the dielectric resonator 30 provided in this embodiment of the present invention and the dielectric resonator 20 provided in the foregoing embodiment lies in that the dielectric resonator 30 provided in this embodiment of the present invention further includes the part 305 that is configured to seal the demetallized notch 304 and that is located the specific spacing away from the demetallized notch 304. In subsequent descriptions, the part 305 that is configured to seal the demetallized notch 304 and that is located the specific spacing away from the demetallized notch 304 is called a sealing part for short in all the embodiments. Therefore, the following describes only the sealing part 305. For descriptions of the solid dielectric resonator body 301, the blind hole 302, the metalized layer 303, and the demetallized notch 304 that are included in the dielectric resonator 30, reference may be made to the descriptions of the foregoing embodiment in FIG. 2, and details are not described herein again.

The sealing part 305 may be located inside the blind hole 302, as shown in FIG. 3*a*. That the sealing part 305 is located inside the blind hole 302 includes a case in which the sealing part 305 is level with an opening side of the blind hole 302

(as shown in FIG. 3*b*). The sealing part 305 is parallel to the opening side of the blind hole, and a shape and an area of a cross-section of the sealing part are the same as those of a cross-section of the blind hole; or the sealing part 305 may not be parallel to the opening side of the blind hole (which is not shown in the figures). Regardless of whether the sealing part 305 is parallel to the opening side of the blind hole, it is acceptable as long as the shape and area of the cross-section of the sealing part are the same as a shape and an area that are required for sealing the blind hole. At least a surface that is of an outer surface of the sealing part 305 and that is in a same direction as the opening side of the blind hole is a metalized surface. It may be understood that other parts of the outer surface may also be a metalized surface, which may not be limited in this embodiment. The sealing part may be connected to a surface of the blind hole by welding, or may be connected to a surface of the blind hole in a squeezing manner, or another manner may further be used. A higher sealing degree that the sealing part is connected to the surface of the blind hole reduces signal energy that is leaked.

The sealing part 305 may also be located outside the blind hole 302, as shown in FIG. 3*c*. In this case, the sealing part 305 is connected to a metalized layer surrounding the opening side of the blind hole 302, so as to cover the blind hole 302. An area of the sealing part 305 is greater than an area of the opening side of the blind hole 302. A surface, connecting to the metalized layer surrounding the opening side of the blind hole, of the sealing part 305 is a metalized surface, and another surface of the sealing part 305 may also be a metalized surface, which may not be limited in this embodiment. The sealing part 305 may be connected to the metalized layer surrounding the opening side of the blind hole 302 in a manner such as pressing, welding, or buckling, or in another manner. A higher sealing degree that the sealing part is connected to the metalized layer surrounding the opening side of the blind hole reduces signal energy that is leaked.

Considering that at least one side of the outer surface of the sealing part 305 is metalized to reduce signal energy that is leaked from the dielectric resonator, the sealing part 305 may also be called a metalized sealing part.

There is a specific spacing between the metalized sealing part and the demetallized notch 304, so as to reduce impact of the metalized sealing part on the resonance frequency of the dielectric resonator that is already tuned. A width of the spacing is generally related to a dielectric constant of a dielectric of the dielectric resonator and the resonance frequency of the dielectric resonator, and may be specifically determined by simulation or test. In specific implementation, the width of the spacing is generally greater than 1 mm.

According to the dielectric resonator provided in this embodiment of the present invention, a demetallized notch that is configured to tune a resonance frequency of the dielectric resonator is disposed inside a blind hole, which therefore can not only implement tuning of the dielectric resonator, but also reduce impact on the resonance frequency of the dielectric resonator after the dielectric resonator is tuned, where the impact is caused by that the demetallized notch is covered by a metal material in an assembly process of the dielectric resonator, thereby improving performance retentivity. In addition, because the demetallized notch is located inside the blind hole and sealed by a metalized sealing part, signal energy that is leaked from the notch may further be reduced.

An embodiment of the present invention further provides a dielectric filter, where the dielectric filter is formed by the dielectric resonator described in the foregoing embodiments.

Further, an embodiment of the present invention further provides a base station, where at least one of a resonator of the base station and a filter of the base station is formed by the dielectric resonator described in the foregoing embodiments.

Further, an embodiment of the present invention further provides a communications system, which includes the base station provided in the foregoing embodiment.

Figure 4A:
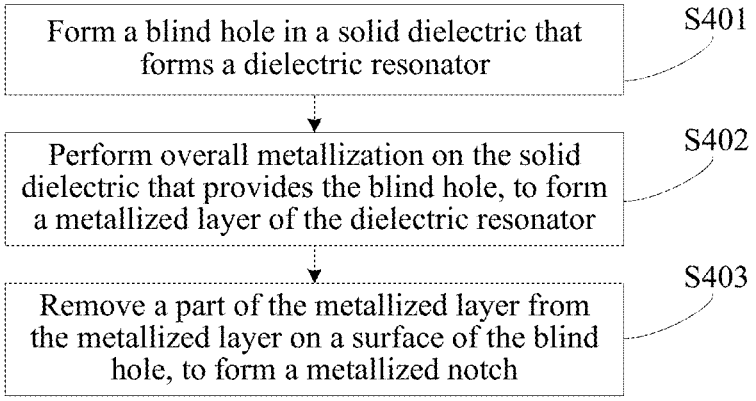
FIG. 4*a* is a schematic flowchart of a method for fabricating a dielectric resonator according to an embodiment of the present invention.

An embodiment of the present invention further provides a method for fabricating a dielectric resonator, as shown in FIG. 4*a*. The method includes:

Step S401: Form a blind hole in a solid dielectric that forms the dielectric resonator.

A specific value of a depth of the blind hole may be determined by simulation or test according to a dielectric constant of a dielectric of the resonator and a resonance frequency of the resonator, so as to reduce signal energy that is leaked from a demetallized notch, and reduce impact on the resonance frequency of the resonator resulting from the blind hole being covered by a metal material in an assembly process. Generally, the value is greater than 1 mm. A cross-section or an opening side of the blind hole may be a circle, may be a square, or may be another shape, for example, an irregular shape, which may not be specifically limited in this embodiment. The blind hole may be a concave blind hole structure, and provides an opening and an inner bottom, where a side with the opening being level with a solid dielectric resonator body is the opening side.

Step S402: Perform overall metallization on the solid dielectric that provides the blind hole, to form a metalized layer of the dielectric resonator.

A manner of performing overall metallization on the solid dielectric that provides the blind hole may be formed by plating or laser, or may be formed by another manner that meets an actual requirement, which may not be limited in this embodiment. A metal may be silver or copper, or may be another metal that meets an actual requirement, which may not be limited in this embodiment. Overall indicates all surfaces, including the surface of the blind hole.

Step S403: Remove a part of the metalized layer from the metalized layer on a surface of the blind hole, to form a demetallized notch.

In specific implementation, removing a part or all of the metalized layers may be done in a polishing manner or in another manner such as laser, which may not be limited herein. Removing a part of the metalized layer is called demetallization processing. In a notch part, the solid dielectric resonator body is visible, that is, a metalized layer of the notch part is demetallized, so that a solid part of a solid dielectric resonator is not covered by a metal layer. For example, if a thickness of the metalized layer is 0.1 mm, a depth of the notch is not less than 0.1 mm. More preferably, at least one place of the metalized layer is removed from the metalized layer on the surface of the blind hole, to form at least one demetallized notch, and a specific quantity may be set according to an actual requirement, which may not be limited in this embodiment. A part of the metalized layer may be removed from the metalized layer on a surface at the inner bottom of the blind hole, to form the demetallized notch. A shape of the demetallized notch may be a circle, may be a square, or may be another shape, for example, an irregular shape, which may not be specifically limited in this embodiment.

The removing a part of the metalized layer from the metalized layer on a surface of the blind hole is specifically tuning the resonance frequency of the dielectric resonator by controlling an area of the removed part of the metalized layer. That is, a purpose of tuning the resonance frequency of the dielectric resonator may be achieved by controlling the area of the demetallized notch. A specific relationship between the area of the demetallized notch and the resonance frequency of the dielectric resonator may be specifically determined by simulation or test, and details are not described in this embodiment.

For a dielectric resonator fabricated by using the fabrication method provided in this embodiment of the present invention, reference may be made to the descriptions of the dielectric resonator in other embodiments. A demetallized notch that is configured to tune a resonance frequency of the dielectric resonator is disposed in a blind hole structure, and an opening of the blind hole structure is sealed by a metalized sealing part. Therefore, the dielectric resonator can not only implement tuning of the dielectric resonator, but also reduce impact on the resonance frequency of the dielectric resonator after the dielectric resonator is tuned, where the impact is caused by that the demetallized notch is covered by a metal material in an assembly process of the dielectric resonator, thereby improving performance retentivity. In addition, because the demetallized notch is located inside the blind hole, signal energy that is leaked from the notch may be reduced.

Figure 4B:
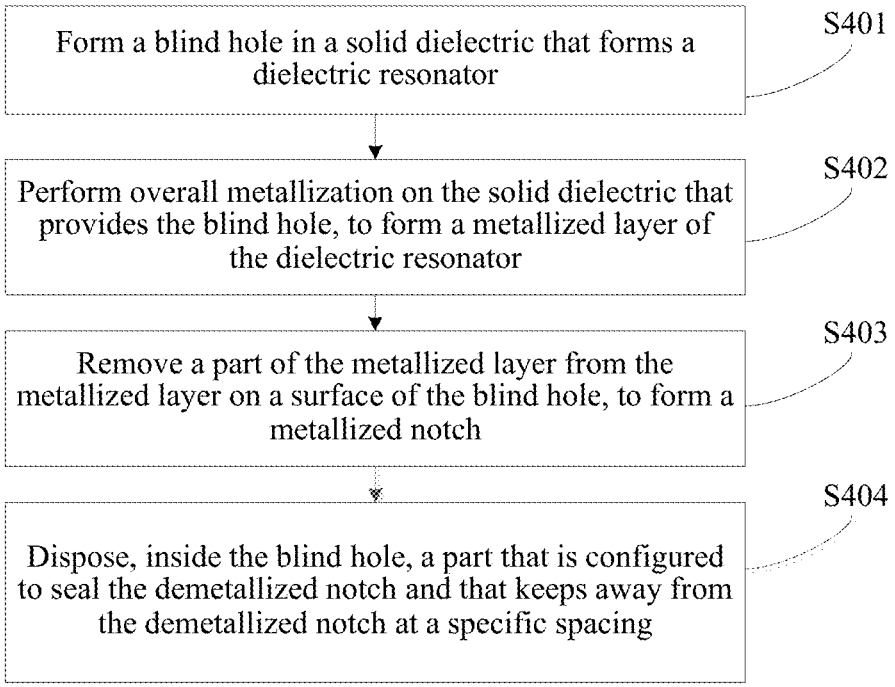
FIG. 4*b* is a schematic flowchart of a method for fabricating a dielectric resonator according to an embodiment of the present invention.

Another embodiment of the present invention further provides a method for fabricating a dielectric resonator, as shown in FIG. 4*b*. The method includes Steps S401, S402 and S403 in the method for fabricating a dielectric resonator as described and shown in FIG. 4*a* in the foregoing embodiment, description thereof is not repeated, and further includes:

Step S404: Dispose, inside the blind hole, a part that is configured to seal the demetallized notch and that is located a specific spacing away from the demetallized notch.

The part that is configured to seal the demetallized notch and that is located the specific spacing away from the demetallized notch is called a sealing part for short in this embodiment.

The disposing the sealing part inside the blind hole includes a case in which the sealing part is disposed in level with an opening side of the blind hole.

The sealing part may be parallel to the opening side of the blind hole, and a shape and an area of a cross-section of the sealing part are the same as those of a cross-section of the blind hole; or the sealing part may not be parallel to the opening side of the blind hole. Regardless of whether the sealing part is parallel to the opening side, it is acceptable as long as the shape and area of the cross-section of the sealing part are the same as a shape and an area that are required for sealing the blind hole. At least a surface that is of an outer surface of the sealing part and that is in a same direction as an opening of the blind hole is a metalized surface. It may be understood that another part of the outer surface may also be a metalized surface, which may not be limited in this embodiment. Considering that at least one side of the outer surface of the sealing part is metalized to reduce signal energy that is leaked from the dielectric resonator, the sealing part may also be called a metalized sealing part.

The disposing the sealing part may be connecting the sealing part to a surface of the blind hole by welding, or may be connecting to a surface of the blind hole in a squeezing manner, or may be in another manner. A higher sealing degree that the sealing part is connected to the surface of the blind hole reduces signal energy that is leaked.

There is a specific spacing between the metalized sealing part and the demetallized notch, so as to reduce impact of the metalized sealing part on the resonance frequency of the dielectric resonator that is already tuned. A width of the spacing is generally related to a dielectric constant of a dielectric of the dielectric resonator and the resonance frequency of the dielectric resonator, and may be specifically determined by simulation or test. In specific implementation, the width of the spacing is generally greater than 1 mm.

Figure 4C:
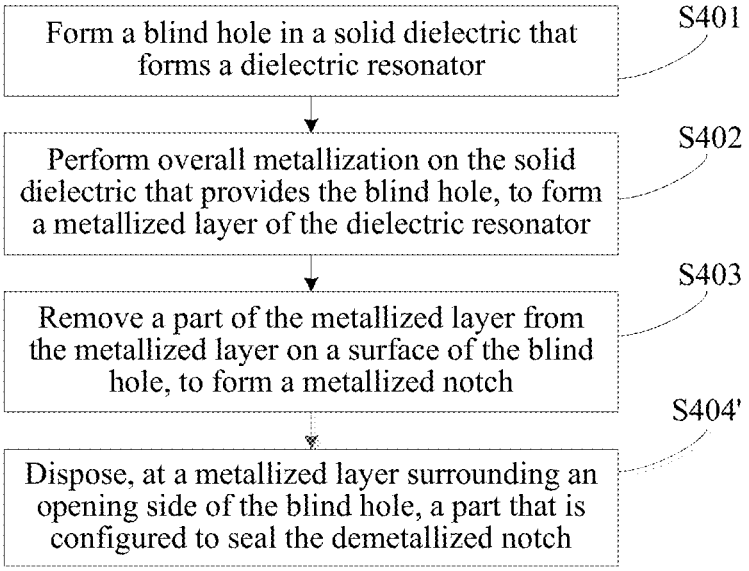
FIG. 4*c* is a schematic flowchart of a method for fabricating a dielectric resonator according to an embodiment of the present invention.

Another embodiment of the present invention further provides a method for fabricating a dielectric resonator, as shown in FIG. 4*c*. The method includes Steps S401, S402 and S403 in the method for fabricating a dielectric resonator as described and shown in FIG. 4*a* in the foregoing embodiment, description thereof is not repeated, and further includes:

Step S404': Dispose, at a metalized layer surrounding an opening side of the blind hole, a part that is configured to seal the demetallized notch.

The part that is configured to seal the demetallized notch may be called a metalized sealing part for short. A surface, connecting to the metalized layer surrounding the opening side of the blind hole, of the metalized sealing part is a metalized surface, and another surface of the sealing part may also be a metalized surface, which may not be limited in this embodiment. An area of the metalized sealing part is greater than an area of the opening side of the blind hole. The disposing the sealing part includes connecting the metalized sealing part to the metalized layer surrounding the opening side of the blind hole. The disposing the sealing part may be specifically implemented in a manner such as pressing, welding, or buckling, or in another manner. A higher sealing degree that the metalized sealing part is connected to the metalized layer surrounding the opening side of the blind hole reduces signal energy that is leaked.

For a dielectric resonator fabricated by using the method for fabricating a dielectric resonator provided in this embodiment of the present invention, reference may be made to the descriptions of the dielectric resonator in other embodiments. A demetallized notch that is configured to tune a resonance frequency of the dielectric resonator is disposed inside a blind hole. Therefore, the dielectric resonator can-not only implement tuning of the dielectric resonator, but also prevent a change, after the dielectric resonator is tuned, of the resonance frequency of the dielectric resonator due to that the demetallized notch is covered by a metal material in an assembly process of the dielectric resonator, thereby improving performance retentivity. In addition, because the demetallized notch is located inside the blind hole and sealed by a metalized sealing part, signal energy that is leaked from the notch may further be reduced.

An embodiment of the present invention further provides a method for fabricating a dielectric filter. The dielectric filter is formed by a dielectric resonator fabricated by using the method for fabricating a dielectric resonator provided in the foregoing embodiments; therefore, the method for fabricating a dielectric filter includes the steps of the method for fabricating a dielectric resonator provided in the foregoing embodiments. For details, reference may be made to the foregoing embodiments, and details are not described herein again.

Persons of ordinary skill in the art may understand that all or a part of the steps of the method embodiments may be implemented by a program instructing related hardware. The foregoing program may be stored in a computer readable storage medium. When the program executes, the steps of the method embodiments are performed. The foregoing storage medium includes: any medium that can store program code, such as a ROM, a RAM, a magnetic disk, or an optical disc.

Persons of ordinary skill in the art may understand that a name of an apparatus or module in the embodiments of the present invention may be evolved with technologies or be changed with application scenarios, which does not affect implementation of the embodiments of the present invention and shall fall within the scope of the present disclosure. The apparatus or module in the embodiments of the present invention is divided based on a function, and may be combined or divided physically.

The foregoing embodiments are merely intended to exemplarily describe the technical solutions of the present invention, but not intended to limit the present invention. Although the present invention is described in detail with reference to the foregoing embodiments, persons of ordinary skill in the art should understand that they may still make modifications to the technical solutions described in the foregoing embodiments or make equivalent replacements to some technical features thereof, without departing from the scope of the technical solutions of the embodiments of the present invention.

The foregoing descriptions are merely specific implementation manners of the present invention, but are not intended to limit the protection scope of the present disclosure. Any variation or replacement readily figured out by persons skilled in the art within the technical scope disclosed in the present invention shall fall within the protection scope of the present invention. Therefore, the protection scope of the present invention shall be subject to the protection scope of the claims.

What is claimed is:

1. A dielectric resonator comprising:

a solid dielectric resonator body;

a blind hole located on one side of the solid dielectric resonator body;

a metalized layer covering both a surface of the solid dielectric resonator body and a surface of the blind hole;

at least one demetallized notch located at the metalized layer on the surface of the blind hole; and at least one sealing part that is metalized and configured to seal the at least one demetallized notch and is sufficiently spaced away from the at least one demetallized notch to prevent the metalized at least one sealing part from influencing a frequency of the dielectric resonator.

2. The dielectric resonator according to claim 1, wherein the blind hole is located on an upper surface, a bottom surface or a lateral side of the solid dielectric resonator body.

3. The dielectric resonator according to claim 1, wherein the at least one sealing part is located inside the blind hole and connected to the surface of the blind hole, and a surface of the at least one sealing part is a metalized surface, wherein the surface of the at least one sealing part is oriented in a same direction as an opening of the blind hole.

4. The dielectric resonator according to claim 1, wherein the at least one sealing part is located outside the blind hole and connected to a metalized layer surrounding an opening side of the blind hole, and a surface of the at least one sealing part is a metalized surface, wherein the surface of the at least one sealing part connects to the metalized layer surrounding the opening side of the blind hole.

5. The dielectric resonator according to claim 1, wherein a width of a determined spacing is related to a dielectric constant of a dielectric of the dielectric resonator and a resonance frequency of the dielectric resonator.

6. The dielectric resonator according to claim 1, wherein a width of a determined spacing is greater than 1 mm.

7. The dielectric resonator according to claim 1, wherein an area of the at least one demetallized notch is related to a resonance frequency of the dielectric resonator.

8. The dielectric resonator according to claim 1, wherein a depth of the blind hole is determined according to a dielectric constant of a dielectric of the dielectric resonator and a resonance frequency of the dielectric resonator.

9. A dielectric filter comprising a dielectric resonator, wherein, the dielectric resonator comprises:

a solid dielectric resonator body;

a blind hole located on one side of the solid dielectric resonator body;

a metalized layer covering both a surface of the solid dielectric resonator body and a surface of the blind hole;

at least one demetallized notch located at the metalized layer on the surface of the blind hole; and at least one sealing part that is metalized and configured to seal the at least one demetallized notch and is sufficiently spaced away from the at least one demetallized notch to prevent the metalized at least one sealing part from influencing a frequency of the dielectric resonator.

10. The dielectric filter according to claim 9, wherein the at least one sealing part is located inside the blind hole and connected to the surface of the blind hole, and a surface of the at least one sealing part is a metalized surface, wherein the surface of the at least one sealing part is oriented in a same direction as an opening of the blind hole.

11. The dielectric filter according to claim 9, wherein the at least one sealing part is located outside the blind hole and connected to a metalized layer surrounding an opening side of the blind hole, and a surface of the at least one sealing part is a metalized surface, wherein the surface of the at least one sealing part connects to the metalized layer surrounding the opening side of the blind hole.

12. A base station comprising a dielectric filter, wherein the dielectric filter comprising a dielectric resonator, wherein, the dielectric resonator comprises:

a solid dielectric resonator body;

a blind hole located on one side of the solid dielectric resonator body;

a metalized layer covering both a surface of the solid dielectric resonator body and a surface of the blind hole;

at least one demetallized notch located at the metalized layer on the surface of the blind hole; and at least one sealing part that is metalized and configured to seal the at least one demetallized notch and is sufficiently spaced away from the at least one demetallized notch to prevent the metalized at least one sealing part from influencing a frequency of the dielectric resonator.

13. The base station according to claim 12, wherein an area of the at least one demetallized notch is related to a resonance frequency of the dielectric resonator.

14. The base station according to claim 12, wherein a width of a determined spacing is greater than 1 mm.

15. The base station according to claim 12, wherein a width of a determined spacing is related to a dielectric constant of a dielectric of the dielectric resonator and a resonance frequency of the dielectric resonator.

16. The base station according to claim 12, wherein the at least one sealing part is located inside the blind hole and connected to the surface of the blind hole, and a surface of the at least one sealing part is a metalized surface, wherein the surface of the at least one sealing part is oriented in a same direction as an opening of the blind hole.

17. The base station according to claim 12, wherein the at least one sealing part is located outside the blind hole and connected to a metalized layer surrounding an opening side of the blind hole, and a surface of the at least one sealing part is a metalized surface, wherein the surface of the at least one sealing part connects to the metalized layer surrounding the opening side of the blind hole.

* * * * *